US011560297B2

(12) United States Patent
De Jong et al.

(10) Patent No.: US 11,560,297 B2
(45) Date of Patent: Jan. 24, 2023

(54) LIFTING SYSTEM WITH INDOOR POSITIONING SYSTEM AND METHOD THEREFOR

(71) Applicant: Stertil B.V., Kootstertille (NL)

(72) Inventors: Jurjen Jan De Jong, Buitenpost (NL); Rudolf Jacobus Antonius van Houten, Twijzelerheide (NL)

(73) Assignee: Stertil B.V., Kootstertille (NL)

( * ) Notice: Subject to any disclaimer, the term of this patent is extended or adjusted under 35 U.S.C. 154(b) by 0 days.

(21) Appl. No.: 15/278,444

(22) Filed: Sep. 28, 2016

(65) Prior Publication Data

US 2017/0088405 A1 Mar. 30, 2017

(30) Foreign Application Priority Data

Sep. 30, 2015 (NL) ..... 2015532

(51) Int. Cl.

| | |
|---|---|
| ***B66F 3/46*** | (2006.01) |
| ***B66F 7/28*** | (2006.01) |
| ***B66F 7/20*** | (2006.01) |
| ***B66F 7/10*** | (2006.01) |
| ***B66F 17/00*** | (2006.01) |

(52) U.S. Cl.

CPC ..... *B66F 7/28* (2013.01); *B66F 3/46* (2013.01); *B66F 7/10* (2013.01); *B66F 7/20* (2013.01); *B66F 17/00* (2013.01)

(58) Field of Classification Search

CPC ..... B66F 1/00; B66F 3/24; B66F 7/00; B66F 9/00; B66F 7/28; B66F 7/20; B66F 17/00; B66F 3/46; B66F 7/10

See application file for complete search history.

(56) References Cited

U.S. PATENT DOCUMENTS

| | | | | |
|---|---|---|---|---|
| 6,634,461 | B1 | 10/2003 | Baker | |
| 2006/0182563 | A1 | 8/2006 | De Jong et al. | |
| 2008/0277204 | A1 | 11/2008 | Moller et al. | |
| 2009/0087290 | A1 * | 4/2009 | Wastel | B66F 7/02 414/240 |
| 2009/0236183 | A1 * | 9/2009 | Bordwell | B66F 3/46 187/234 |
| 2011/0037041 | A1 * | 2/2011 | DeJong | B66F 3/46 254/89 R |
| 2012/0218564 | A1 * | 8/2012 | Wustefeld | G01S 7/497 356/614 |
| 2013/0240300 | A1 | 9/2013 | Fagan et al. | |

(Continued)

FOREIGN PATENT DOCUMENTS

| | | | |
|---|---|---|---|
| WO | 2009099322 | A1 | 8/2009 |
| WO | 2015005772 | A1 | 1/2015 |

(Continued)

*Primary Examiner* — Nirvana Deonauth

(74) *Attorney, Agent, or Firm* — The Webb Law Firm

(57) ABSTRACT

The present invention relates to a lifting system and method for lifting a vehicle, wherein the lifting system including one or more lifting devices and: a frame with a carrier configured for carrying the vehicle; a drive for driving the carrier in at least one of the ascent or descent of the carrier; and a controller including an indoor positioning system with a transponder, wherein the transponder is provided on or at the carrier such that the controller determines the location and the height of the carrier in at least one of the ascent or descent of the carrier.

17 Claims, 7 Drawing Sheets

(56) References Cited

U.S. PATENT DOCUMENTS

| | | | | |
|---|---|---|---|---|
| 2013/0299440 | A1* | 11/2013 | Hermann | B66C 13/46<br>212/276 |
| 2015/0232310 | A1* | 8/2015 | Jaipaul | B66F 3/46<br>414/800 |
| 2016/0185580 | A1 | 6/2016 | Luinge | |

FOREIGN PATENT DOCUMENTS

| | | | | |
|---|---|---|---|---|
| WO | WO-2015005771 | A1 * | 1/2015 | B66F 3/46 |
| WO | WO-2015106307 | A1 * | 7/2015 | E04G 21/166 |

* cited by examiner

LIFTING SYSTEM WITH INDOOR POSITIONING SYSTEM AND METHOD THEREFOR

CROSS-REFERENCE TO RELATED APPLICATION

This application claims priority to Netherlands Patent Application No. 2015532 filed Sep. 30, 2015, the disclosure of which is hereby incorporated in its entirety by reference.

BACKGROUND OF THE INVENTION

Field of the Invention

The invention relates to a lifting system, more specifically a vehicle lifting system. In general, lifting systems are specifically used for lifting passenger cars, trucks, busses, or other vehicles and may involve a system comprising one or more moveable lifts or lifting devices, such as (mobile) lifting columns, lifting columns of the two-post lift type with pivoting support arms, the four-post lift type with runways, the mobile type, in-ground lifts etc.

Description of Related Art

Conventional lifting systems comprise a frame with a carrier that is connected to a drive for moving the carrier upwards and downwards. In the ascent mode, hydraulic oil is pumped to a cylinder for lifting the carrier and, therefore, the vehicle. In the descent mode, the carrier with the vehicle is lowered and hydraulic oil returns to the reservoir. Such prior art lifting system is disclosed in U.S. Patent Application Publication No. 2006/0182563, which is incorporated herein by reference. Such lifting systems as well as other lifting systems require the use of a number of sensors, such as height sensors, to enable correct operation of the lifting system. This involves integration of these sensors and related components into the control system.

An object of the invention is to reduce complexity of vehicle lifting systems and/or to improve safety when working with these vehicle lifting systems.

SUMMARY OF THE INVENTION

This object is achieved with a lifting system for lifting a vehicle according to the invention, the lifting system comprising:

- a frame with a carrier configured for carrying the vehicle;
- a drive for driving the carrier in at least one of the ascent or descent of the carrier; and
- a controller comprising an indoor positioning system with a transponder, wherein the transponder is provided on or at the carrier such that the controller determines the location and the height of the carrier in at least one of the ascent or descent of the carrier.

The lifting system according to the invention specifically relates to a vehicle lifting system using a number of lifting devices, including lifting columns, mobile lifting columns, lifting columns of the two-post lift type with pivoting support arms, the four-posts lift type with runways, in-ground lifts, for example. In the context of the present invention the carrier relates to the moving parts of the lifting device when lifting the vehicle. This carrier is driven by a drive, such as a hydraulic drive, pneumatic drive and/or electric drive.

The lifting system according to the present invention comprises a controller with an indoor positioning system. Such indoor positioning system is capable of communicating with one or more transponders, also referred to as transmitter and responder. The transponder transmits a message in response to a received message. The indoor positioning system is capable of locating the lifting device, and more specifically the carrier of the lifting device, inside a building, using radio waves, magnetic fields, acoustic signals or other means of transferring information. Possibly, a combination of signals can be applied. With the use of optical, radio or acoustic technologies, or other convenient technologies, the position and height of the carrier can be determined. Preferably, at least three independent measurements are used by the control system to determine the location and height of the carrier involving the use of trilateration.

The transponders may relate to so-called active transponders that are provided with an energy supply such as a battery or power supply. Also, transponders may relate to so-called passive transponders that receive the required energy from the received signal. An indoor positioning system using wi-fi signals is also referred to as a wi-fi-based positioning system. Also, blue tooth and other signals can be used in addition or as an alternative. Alternatively, or in combination with the aforementioned active and/or passive transponders, other devices acting as transponder can be applied. In the context of the present invention a transponder is a device that is capable of generating or forwarding a signal indicative for its location (and height), preferably in response to an interrogating (received) signal.

By providing the transponder on or at the carrier, both location and height of the carrier can be determined with the indoor positioning system of the controller. This obviates the need for separate height sensors, as the transponder can be used for both location determination and for height measurement of the carrier during the lifting operation. This renders the lifting system less complex. Location of lifting devices is used when selecting lifting devices for a lifting system. This specifically relates to mobile lifting column, for example. The height measurement is relevant for all types of lifting devices.

As an example, in an embodiment of a lifting system according to the invention, at least two lifting columns are being used as lifting devices. In fact, often four lifting columns are being used. When lifting a vehicle, controlling the actual height of the carriers of these separate lifting columns and optionally also the moving speed of the carrier that carries (part of) the vehicle when lifting a vehicle requires synchronization. The controller preferably synchronizes the height of the separate carriers in the ascent mode using, for example, a measurement signal generated by the indoor positioning system. In case one of the carriers has moved too fast in the ascent mode and is too high as compared to the other carriers of the other lifting columns the power supply to this carrier is either directly or indirectly lowered so that the other carriers can catch up or, alternatively, the power supply to the other carriers is either directly or indirectly increased so that the other carriers can catch up. In the descent mode, it is also important that the height of the carriers between the several lifting columns is synchronized. Therefore, in case one of these carriers has moved too slowly, its power supply is increased in order for this carrier to catch up with the other carriers or, alternatively, the power supply to the other carriers is either directly or indirectly lowered so that the other carriers can catch up.

Other types of lifting devices involve a similar (synchronization) operation and may also benefit from the use of the indoor positioning system.

Preferably, the controller further comprises an orientation detector. With the orientation detector, the orientation of the lifting device can be established with the indoor positioning system. For example, the orientation of a lifting device is relevant when using mobile lifting columns that can be repositioned in a building relative to the vehicle to be lifted. In one of the embodiments according to the present invention, the orientation detector is a further transponder. Alternatively or in addition thereto, the orientation detector comprises an electronic compass or so-called magnetometer. An example of such magnetometer is known from consumer devices such as mobile phones and tablet computers.

In a presently preferred embodiment according to the present invention the controller further comprises a monitoring system configured for monitoring a safety zone.

By providing a monitoring system, the lifting system can be protected with a safety zone. This safety zone defines an area or zone that is monitored using one or more sensors, optionally including transponders. When a person and/or object enters the safety zone and/or is present in the safety zone, movement of the carrier is optionally blocked by the controller. This increases safety when working with the system according to the present invention. This safety zone preferably is a three-dimensional zone that can be shaped as a wall, circle, sphere, dome, or any other appropriate shape. The safety zone can be shaped with one or more boundaries. For example, in one embodiment the safety zone comprises an inner working zone and an outer non-working zone. In another embodiment the safety zone comprising an inner non-working zone, for example directly under the lifting device, an intermediate working zone, and an outer non-working zone. It will be understood that other examples of the shape and size of the safety zone can be envisaged.

In a further preferred embodiment according to the present invention the monitoring system comprises an adaptation system that is configured for adjusting the boundaries of the safety zone.

Preferably, the monitoring system comprises an adaptation system configured for adjusting the boundaries of the safety zone. In a presently preferred embodiment, the adaptation system responds to a height measurement of the carrier. The adaptation system may adjust the boundaries of the safety zone, rendering the safety zone dynamic in size and/or shape. Other parameters may also be used by adaptation system, such as the presence and/or type of vehicle that is lifted and the distance to other systems and other sets of lifting devices. Therefore, the lifting system may comprise a vehicle detector that is capable of detecting the presence of a vehicle and preferably the vehicle type.

As an example, the adaptation system enables adjustment in response to the actual height of the carrier and/or the presence of a vehicle in the lifting system of the present invention. The safety zone may have a (dynamic) working/operational zone wherein an operator may perform operations with the lifting system. For example, in some cases, in a zone directly under and/or around the lifting system operating the lifting system with a remote control is prohibited. For example, in an in-ground lift the remote control is enabled to operate under the vehicle when the carrier is below a height of about 30 cm. This enables positioning the carriers, for example. This (safety) zone is (dynamically) established in response to a height measurement to prevent a person from getting under the vehicle when moving the carrier, for example. In a further example, the outer boundary of the safety zone defines the maximum distance from the lifting system an operator may use the lifting system. In one of the embodiments, this results in a dynamic safety zone with an inner boundary and an outer boundary. This safety zone can be shaped as a wall, block, three-dimensional shape, dome shape, and other appropriate shapes.

In a further preferred embodiment according to the present invention, the monitoring system further comprises a warning system configured for providing a warning signal and/or control signal in response to a person and/or object provided with a transponder entering and/or being in the safety zone.

By providing a warning system, appropriate warning and/or control signals can be generated. A warning signal can be provided to an operator, for example with a mobile device such as a phone or tablet computer. Also, a warning can be provided to a supervisor or other person or system. Alternatively or in addition thereto, a control signal can be provided to the controller and optionally the lifting system can be blocked until the person and/or object has been removed from the safety zone, for example.

In a further preferred embodiment according to the present invention the monitoring system further comprises an engagement safety system configured for monitoring correct engagement of the carrier to the vehicle when lifting the vehicle.

By providing an engagement safety system a correct engagement of the carrier to the vehicle, for example to the wheel axles, wheels or other engagement area of the vehicle can be monitored. In case of an incorrect engagement, the lifting system can be blocked by the controller. The engagement safety system may use a camera or other sensing device for monitoring the engagement. The transponder can be used by the controller to establishe that the carrier is indeed blocked in case of a warning. This increases the overall safety of the lifting system according to the present invention.

Preferably, the monitoring system further also comprises a descent safety system configured for monitoring a safe descent of the carrier. This is for example advantageously applied to an in-ground lifting system of a fully flush-mounted type. The correct location can be determined by the controller using the transponder on the carrier of the indoor positioning system, for example. For example, such flush-mounted type in-ground lift is described in U.S. Pat. No. 8,523,146, which is incorporated herein by reference. Also, in a presently preferred embodiment of the present invention it is possible that the controller of the lifting system uses the transponders to position the carrier correctly in a descent mode. Correctly positioning the lifting device is optionally done automatically by the controller.

In a further preferred embodiment according to the present invention, the lifting system further comprises a release system for releasing the carrier and enabling the lifting system to lift the vehicle.

By providing a release system, the lifting system can be enabled to lift a vehicle. Preferably, the release system is controlled in cooperation with the monitoring system. Optionally, the release system is controlled by the controller in response to payment instructions, identification and/or authorization procedures. The release system may involve locking and/or unlocking means. This prevents undesired and/or unneeded lifts. In addition, this also enables direct debiting of the vehicle owner for the usage of the lifting system, providing a type of so-called pay-per-lift debiting system. Optionally, the release system receives a clearance signal of a clearance system after payment, identification and/or authorization to perform a number of lifting operations, optionally in a specific time period.

In a further preferred embodiment according to the present invention, the controller further comprises a remote control.

By providing a remote control, the operation of the lifting system is rendered more easy and effective for an operator. The remote control may relate to a mobile phone, tablet computer or other device. Preferably, the indoor positioning system also senses the location of the remote control and uses the information in the monitoring system, for example. This can be achieved by providing the remote control with a transponder of the indoor positioning system, for example.

In a further preferred embodiment according to the present invention, the lifting system comprises two or more sets of lifting devices, wherein each set is configured for lifting a vehicle, the lifting system further comprising a central controller.

By providing a central controller, the controller is capable of controlling multiple lifting systems and/or multiple sets of lifting devises. As an example, when a vehicle needs to be lifted, a set of (mobile) lifting columns is selected and is defined as a group. The central controller controls this group of lifting devices. Another group of lifting devices can also be controlled by the central controller independently. Optionally, the central controller instructs the adjustment system of the monitoring system to amend or adjust boundaries of the safety zone, taking into account the location of the different groups of lifting columns. Furthermore, the central controller may communicate with remote computers or computer systems for maintenance and repair, logistics, debiting etc.

Optionally, the central controller selects a set of lifting devices that is available and most convenient for a user. Next, the user can be provided with a suggested set of lifting devices that he only needs to approve. This prevents the user to contact each individual lifting device that needs to be selected. Optionally, the selection is automatically authorized and the specific set of lifting devices is directly ready for use.

In a further preferred embodiment according to the present invention, the lifting system further comprises one or more tools and/or accessories that comprise a transponder.

By providing tools and/or accessories with a transponder, the indoor positioning system is capable of determining the location of these tools and/or accessories. This information can be used in the safety system, for example. Furthermore, this information can be used by the controller for monitoring location (and height) of tools, such us wheel dollies, axle stands, transmission jacks etc., relative to the vehicle. Optionally, the controller locks the lifting system until the required tools and/or accessories are available on the desired location, for example.

As a further example, in case the remote control with transponders is below 460 mm or 18 inch from the work floor, the remote control can be blocked by the controller and it is no longer active in the lifting system. This contributes to an explosion-proof lifting system.

BRIEF DESCRIPTION OF THE DRAWINGS

Further advantages, features and details of the invention will be elucidated on the basis of preferred embodiments thereof, wherein reference is made to the accompanying drawings, in which.

DETAILED DESCRIPTION OF THE INVENTION

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

Figure 1:
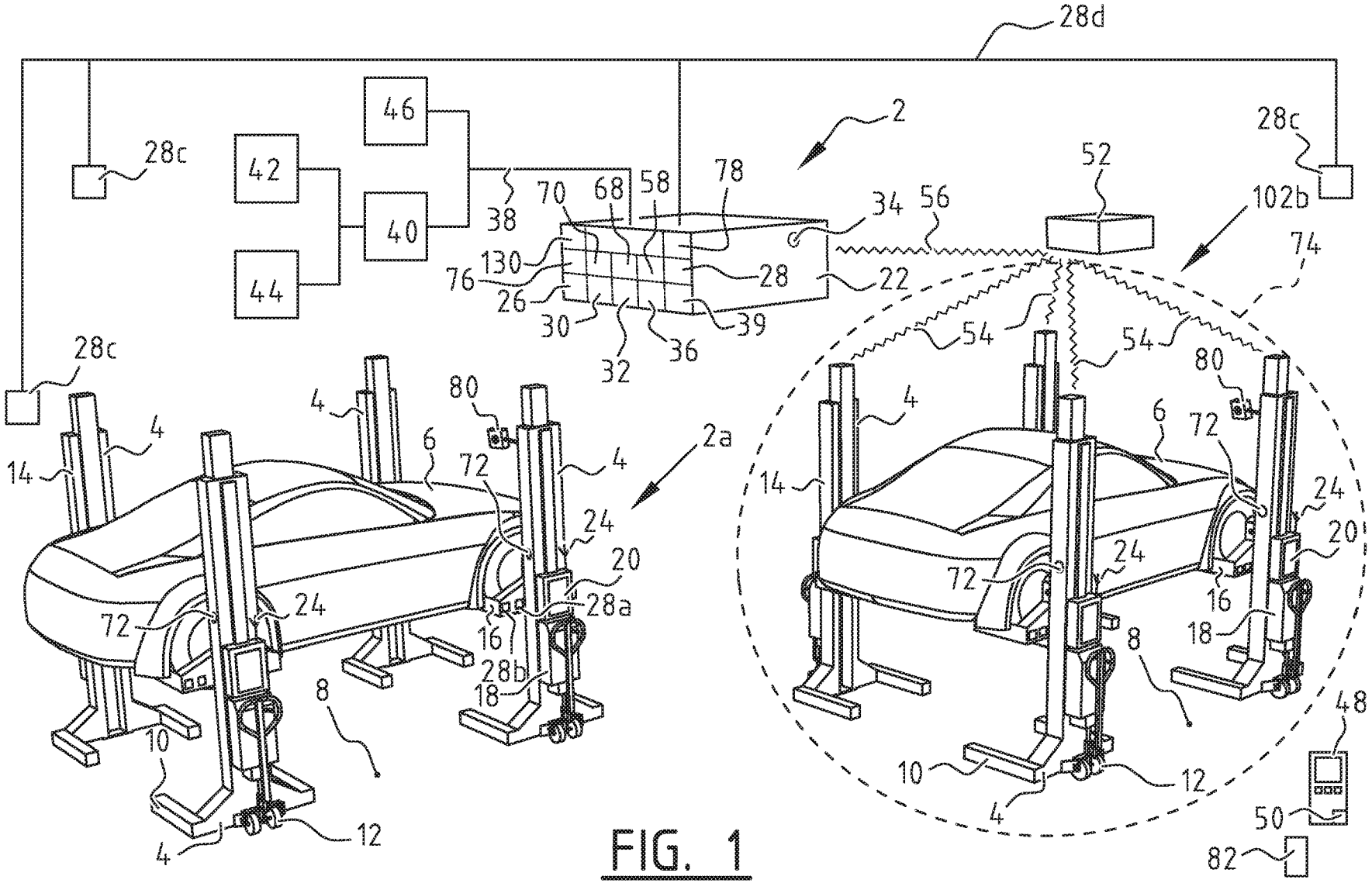
FIG. 1 shows a lifting system with multiple groups of lifting devices and a central controller according to the present invention.

In the illustrated embodiment lifting system 2 (FIG. 1) comprises two sets of mobile lifting columns 2*a*, 2*b*. In the illustrated embodiment each set comprises four mobile lifting columns 4. Lifting columns 4 lift passenger car 6 from ground 8. Lifting columns 4 comprise foot 10 which can travel on running wheels 12 over ground surface 8 of for instance a floor of a garage or workshop. In the forks of foot 10 there is provided an additional running wheel (not shown). Lifting column 4 furthermore comprises mast 14. Carrier 16 is moveable in upward and downward directions along mast 14. Carrier 16 is driven by a motor 18 that is located in a housing of lifting column 4. Motor 18 is supplied with power from the electrical grid, or by a battery that is provided on lifting column 4 in the same housing as motor 18, or alternatively on foot 10 (not shown). Display unit 20 may provide the user with information about the lifting system.

In the illustrated embodiment lifting columns 4 are connected to central controller 22 by wireless communication means 24 on individual lifting column 4 and wireless communication means 26 on central controller 22. Wireless communication means 24, 26 involve one or more transmitters and/or receivers.

The illustrated lifting system 2 includes at least two lifting columns 4. Each of the lifting columns has at least one ascent mode and one descent mode, and is under the influence of central controller 22. In the illustrated embodiment controller 22 is positioned centrally above lifting columns 4 assuring a good communication path between the individual lifting columns 4 and the central controller 22.

Central controller 22 determines the desired control actions. This may involve receiving a measurement signal representing the actual height of a carrier of an individual lifting column that is measured with indoor positioning system 28. In the illustrated embodiment, indoor positioning system 28 is incorporated in central controller 22. Indoor positioning system 28 is capable of measuring position and/or speed of carrier 16. In the illustrated embodiment indoor positioning system 28 comprises a transponder 28*a* and magnetometer 28*b* attached to carriers 16, and a number of "satellites" 28*c* positioned in the vicinity of lifting system 2 and communicating with wired or wireless communication lines 28*d* with central controller 22.

Central controller 22 detects height differences between lifting columns, calculates the required control actions with computing means 30, such as a processor, for individual lifting columns, and communicates the control actions to the relevant individual lifting columns. In the illustrated embodiment battery 32 provides power to central controller 22. Alternatively, or in addition, power is provided through connection 34 to the electrical grid. Data can be stored in memory/storage 36. Central controller 22 is provided with a wired and/or wireless connection 38 to enable connection between communication module 39 of central controller 22 to internal and/or external networks, involving internal company networks for workshop control 40, financial control 42 and maintenance 44, for example, and optionally to external networks 46 of suppliers and/or customers, for example.

Remote control 48 is provided with additional transponder 50 to enable monitoring the position of remote control 48. It will be understood that other tools and/or accessories can also be monitored by indoor positioning system 28.

In the illustrated embodiment there is provided wireless functionality to communicate in one or more environments such as LAN, WAN, VPN intranet, internet etc. that are schematically shown in the illustrated embodiments. Display unit 20 is further provided with input/output ports, such as USB, SD card reader, smart phone communication possibilities etc. to improve the functionality. Display 20 and/or remote control 48 may provide warning signals to the user.

Optionally, central controller 22 is provided with a number of communicators/distributors 52, such as an RF-host, that sends and/or receives signals 54 between lifting columns 4 and communicator 52, and signals 56 between communicator/distributor 52 and central controller 22. Communicators/distributors 52 provide additional robustness to the overall operation of the groups 2*a*, 2*b* of lifting columns 4.

Figure 2:
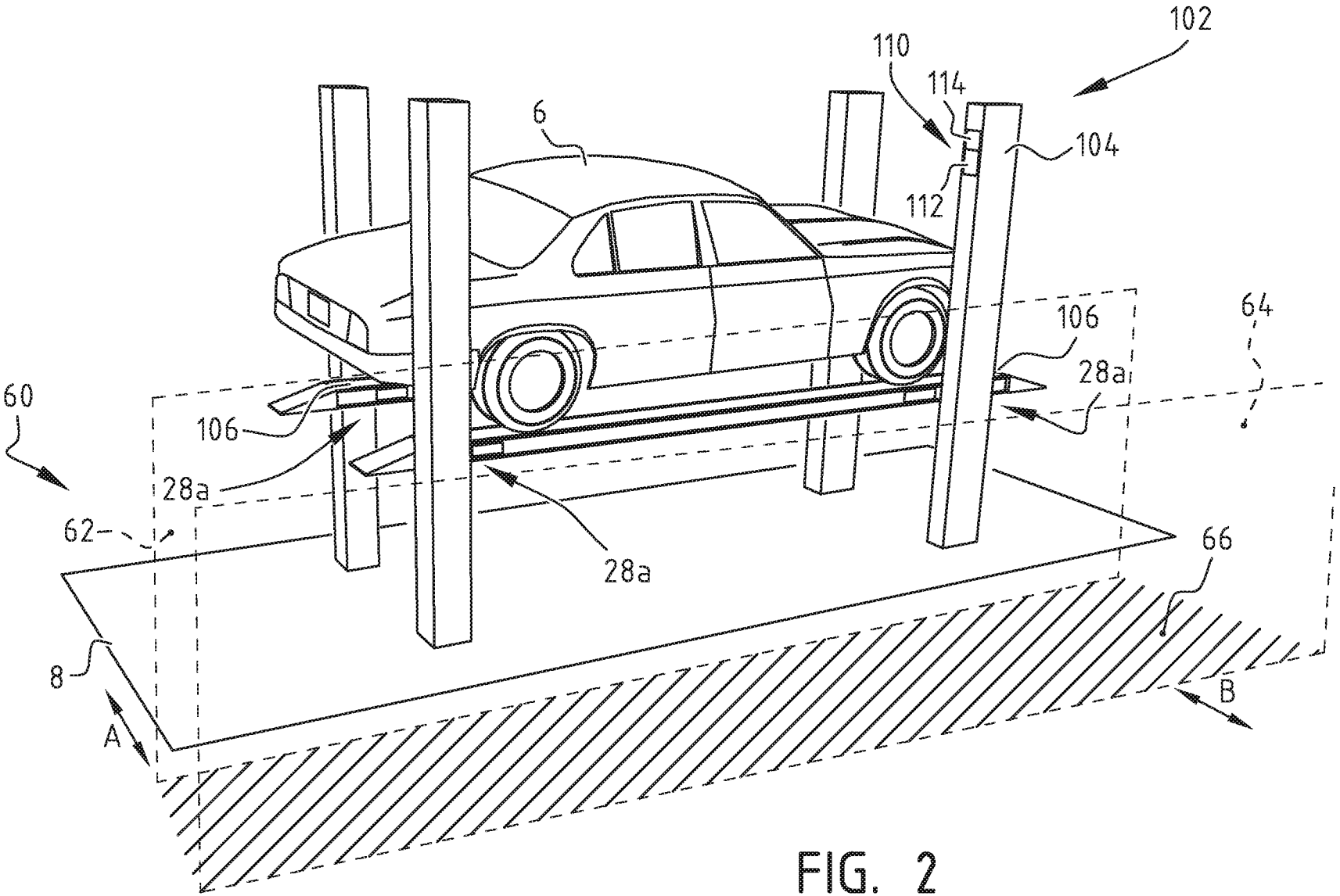
FIGS. 2-6 show alternative embodiments with different types of lifting devices according to the present invention.

In a preferred embodiment, central controller 22 is provided with monitoring system 58 that defines safety zone 60 (for illustrative purposes safety zone 60 is illustrated in FIG. 2). In the illustrated embodiment group, 2*a* is provided with an inner boundary surface or wall 62 and an outer boundary surface or wall 64. The space between walls 62, 64 is working zone 66 wherein an operator is allowed to operate group 2*a*. On the other side of surfaces or walls 62, 64, operation is locked or not authorized. Safety zone can be applied to the different types of lifting devices in the illustrated or another suitable shape.

Preferably, central controller 22 (FIG. 1) comprises adaptation system 68 that is capable of adjusting or adapting boundaries 62, 64 in directions A and B, respectively. Adaptation system 68 responds to indoor positioning system 28. Furthermore, central controller 22 preferably comprises warning system 70 capable of sending a warning to a user or operator in case of a safety issue. For example, in case control of group 2*a* is activated outside working zone 66 a warning message is provided to remote control 48 and/or any other suitable device. Optionally, release system 72 locks and/or unlocks lifting columns 4 thereby locking and/or unlocking movement of carrier 16.

It will be understood that other configurations/designs for safety zone 60 can be envisaged in accordance with the present invention. For example, for group 2*b* a dome-shaped safety zone 74 is illustrated. Optionally, a two-wall safety zone can be provided by monitoring system 58. Other shapes can also be provided, including circular, spherical, donut shapes etc. Optionally, the boundaries are adjustable. As can be appreciated, each safety zone has a different geometric shape. Furthermore, the formation of safety zones involves using more than hard targets to define safety zones. As a result, the controller is able to dynamically define a number of different safety zones.

In the illustrated embodiment central controller 22 further comprises engagement system 76 and descent safety system 78. Engagement system 76 may comprise camera 80 that monitors engagement of carrier 16 to vehicle 6. Camera 80 may also operate as vehicle detector. Alternatively, separate cameras 80 and/or other appropriate sensing means are provided. Descent safety system 78 monitors descent of carrier 16 in relation to its position with indoor positioning system 28. This enables lowering carrier 16 at a desired location.

In system 2, a user optionally performs a selection of lifting columns 4 that are incorporated in a group 2*a*, 2*b* by selecting lifting columns with a key or card 82 or other means. Optionally, controller 22 selects most suitable lifting columns 4 with indoor positioning system 28 and presents the selection to the user. Preferably, the selected group of lifting columns 4 in system 2 is provided with user instructions on one of the lifting columns 4, using display 20 and/or remote control 50, for example. Transmitter/receivers 24, 26 provide the instructions to central system controller 22. On a central level, controller 22 determines the individual control actions to be taken for all lifting columns 4 in system 2. Transmitter/receivers 24, 26 provide the control actions from the central controller to the individual lifting column 4. Information about the actual position of carrier 16 and/or other relevant data is measured by indoor positioning system 28 and the measurement data is provided to central controller 22 that determines if and what control actions are required. In the illustrated embodiment no direct communication between individual lifting columns 4 is required. This significantly contributes to the robustness of lifting system 2.

Operation and control of a single group of lifting columns with a dedicated group controller is also possible in a similar manner as described for the two groups 2*a*, 2*b*. Controller 22 is suitable for use with lifting systems comprising any number of lifting devices 4, including systems having one, two, four or another number of columns 4. The columns 4 may achieve lifting and lowering capability by any means known to those of skill in the art, including hydraulically, electrically, mechanically, and electromechanically. Lifting systems 2 that are compatible with the control system may be stationary and/or permanently affixed or attached to a certain location or may be mobile, capable of being transported via wheels or any other suitable means known to those in the art. With reference to the figures, like element numbers refer to the same element between drawings.

Next, examples will be given of the use of indoor positioning system 28 in combination with other types of lifting devices. It will be understood that also other embodiments according to the present invention can be envisaged.

For example, a four-post lifting system 102 (FIG. 2) comprises four columns 104 carrying runways 106. Preferably, each column 104 has one transponder 28*a* and compass 28*b*. In the illustrated embodiment an indicator 110 with a green light 112 and a red light 114 is provided. Light 110 signals to the driver when vehicle 6 is positioned correctly relative to columns 104 and the vehicle 6 can be lifted. In case each column 104 is connected to indoor positioning system 28 the position of the carrier/runways 106 can be checked. This contributes to the overall safety of the lifting operation.

Figure 3:
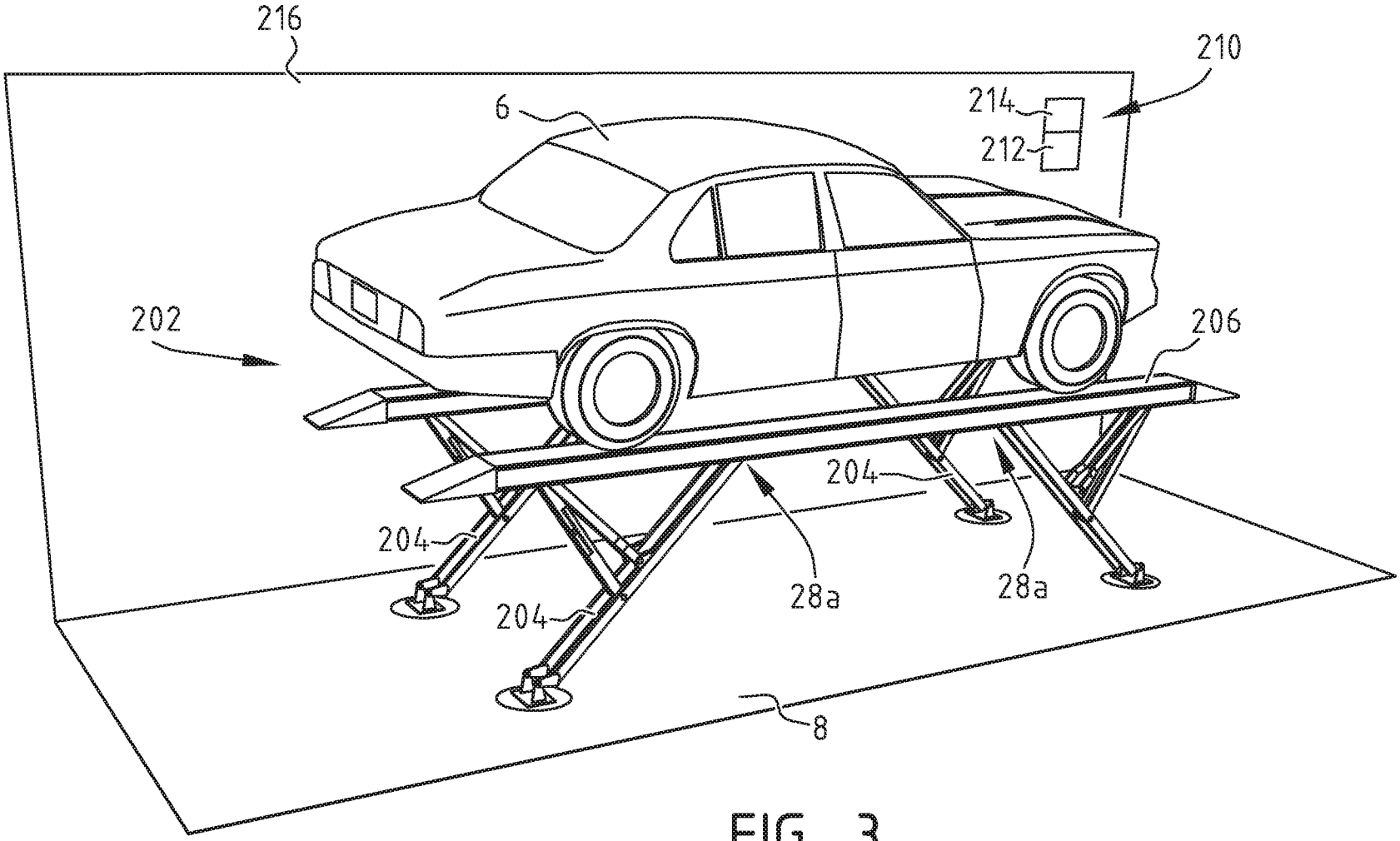

As a further example, lifting system 202 (FIG. 3) comprises a so-called sky-lift configuration with four posts 204 carrying runways 206. In the illustrated embodiment transponder 28*a* and compass 28*b* is provided for every post 204. This enables the check on positioning of the carrier as described earlier by calculating the height of runways 206 from the orientation of posts 204, for example. Optionally, transponder 28*a* is provided directly on or at runways 206. A light 210 with green 212 and red 214 lights can be provided on wall 216 to indicate to the driver of vehicle 6 that the vehicle is positioned correctly or needs to be repositioned.

Figure 4:
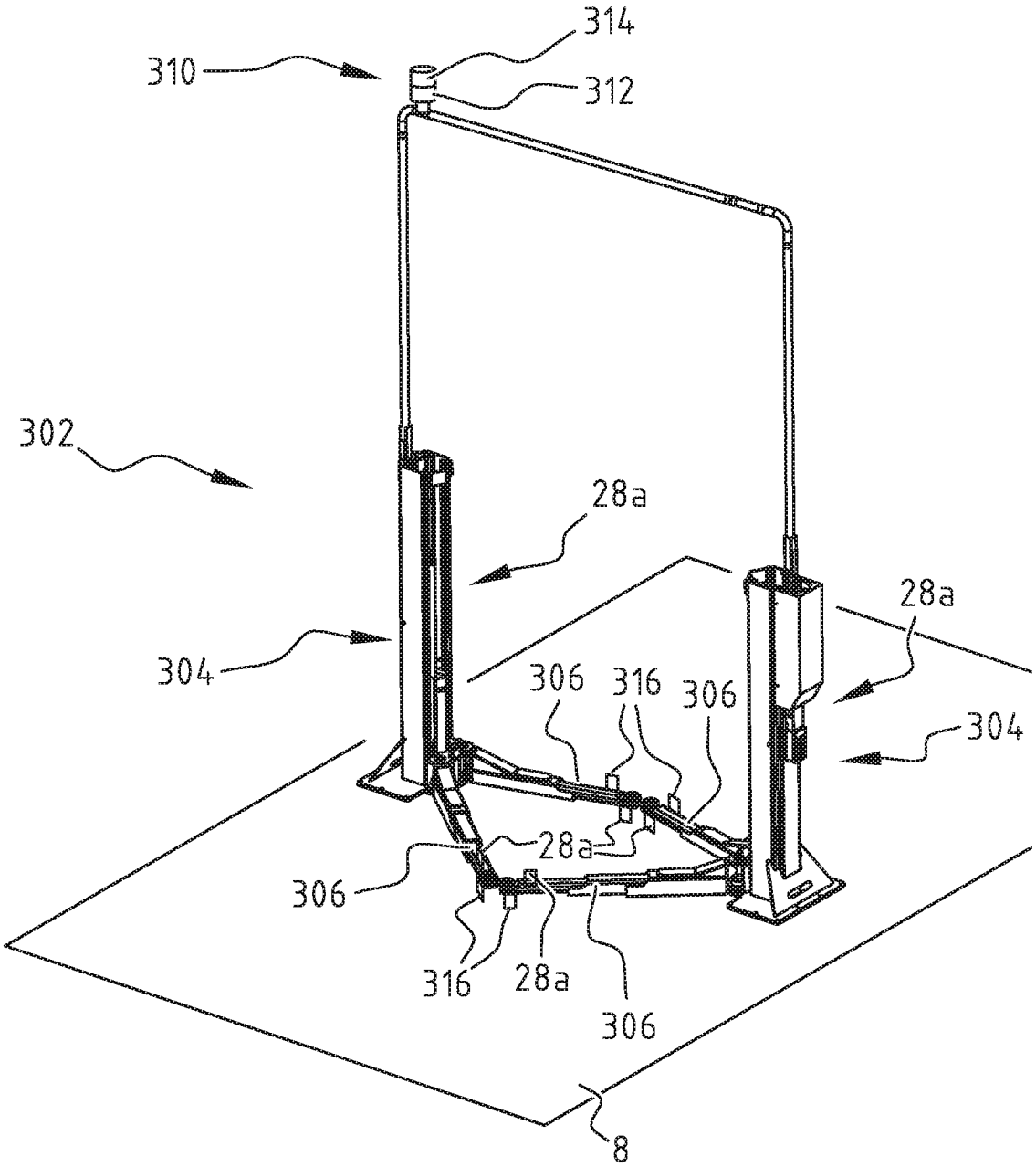

As an even further example, lifting system 302 (FIG. 4) comprises a so-called two-post configuration with two posts 304 that are provided with carrier arms 306. In the illustrated embodiment, to measure position and speed of carrier arms 306 transponder 28*a* is provided. This enables the check on positioning of arms 306 as described earlier. A light 310 with green 312 and red 314 lights can be provided to indicate to the driver of vehicle 6 that the vehicle is positioned correctly or needs to be repositioned.

Providing arms 306 with transponders 28*a* enables monitoring the position and level of extension of arms 306. This enables dynamic adjustment of the maximum load, as a long arm reduces maximum load and a short arm increases maximum load. Load can be measured with load cell 316.

Figure 5A:
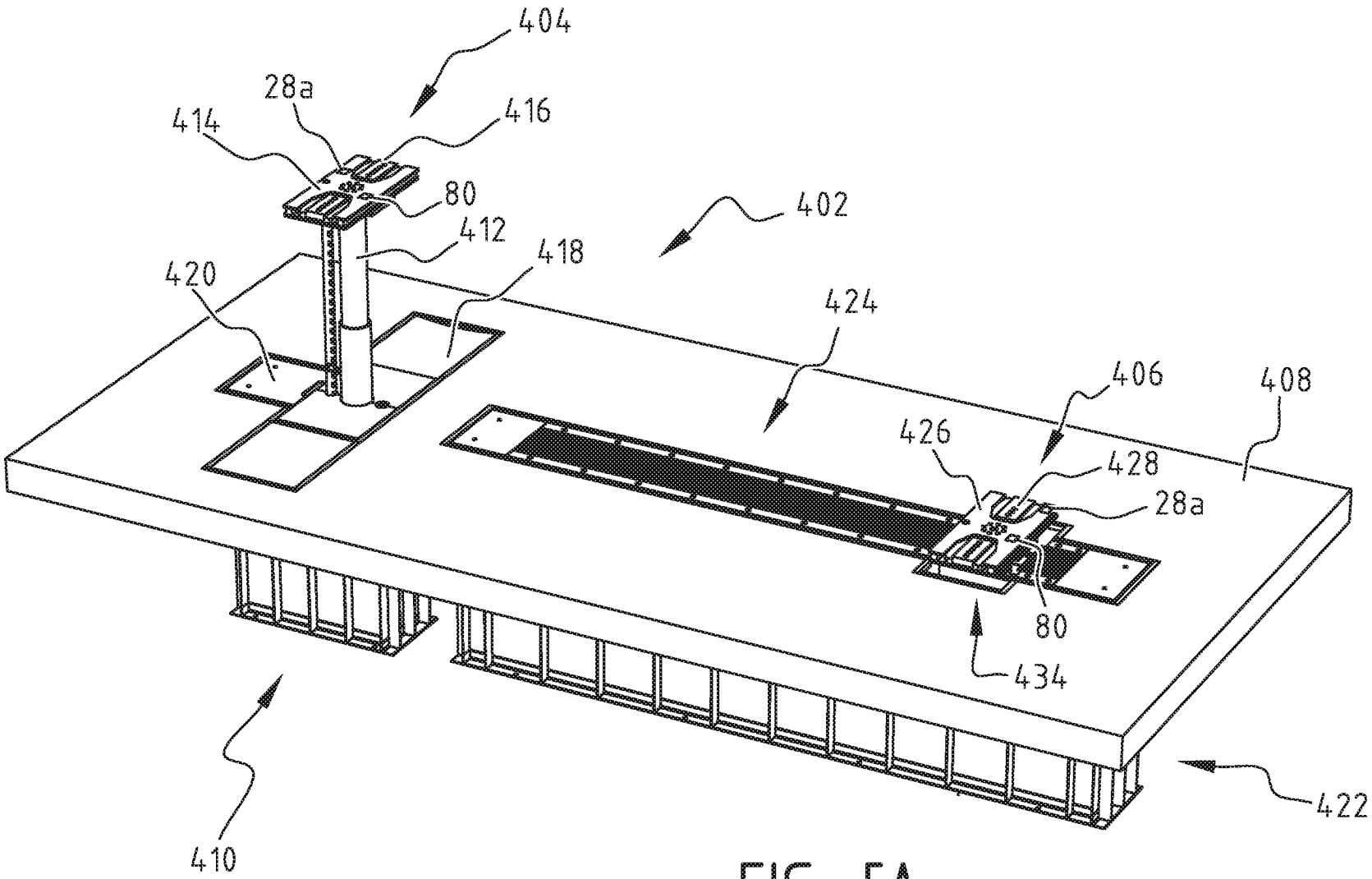
Figure 5B:
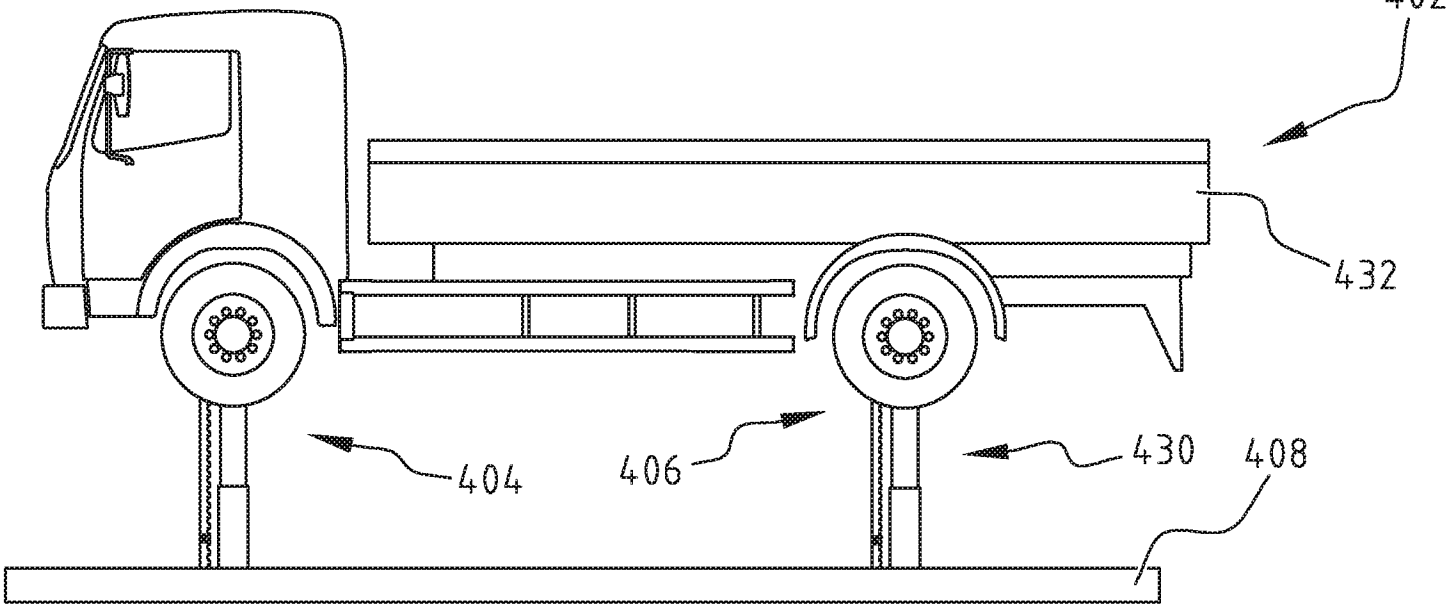

In a further alternative embodiment lifting system 402 (FIG. 5A-B) is of the in-ground lift type comprising stationary lifting column/device 404 and a moveable lifting column/device 406 that are located on or in floor 408. The front lifting column/device 404 is provided in cassette or box 410 with a telescopic lifting cylinder 412. On top of cylinder 412 there is provided carrier 414 with axle carriers 416. In the illustrated embodiment wheel hatches or wheel recesses 418 are provided. Hatches/recesses 418 define the position of the front wheels of the vehicle. Furthermore, in the illustrated embodiment a hatch 420 is provided in front of the front lifting column/device 404 for maintenance, for example.

The moveable lifting column/device 406 moves in cassette or box 422 comprising a telescopic lifting cylinder 430. Box 422 provides a pit with a slot or recess 424 for guiding the moveable lifting column/device 406. Moveable lifting column/device 406 is provided with carrier 426 whereon axle carriers 428 are mounted. Depending on the type of vehicle 432 additional adapters can be provided that cooperate with carriers 414, 426 to enable engagement with different axle dimensions.

Columns/devices 404, 406 are provided with transponders 28*a*. When storing column 406 descent system 78 controls the position of column/device 406 relative to hatches/recesses 434. Optionally, this can be performed automatically by controller 22.

Figure 6:
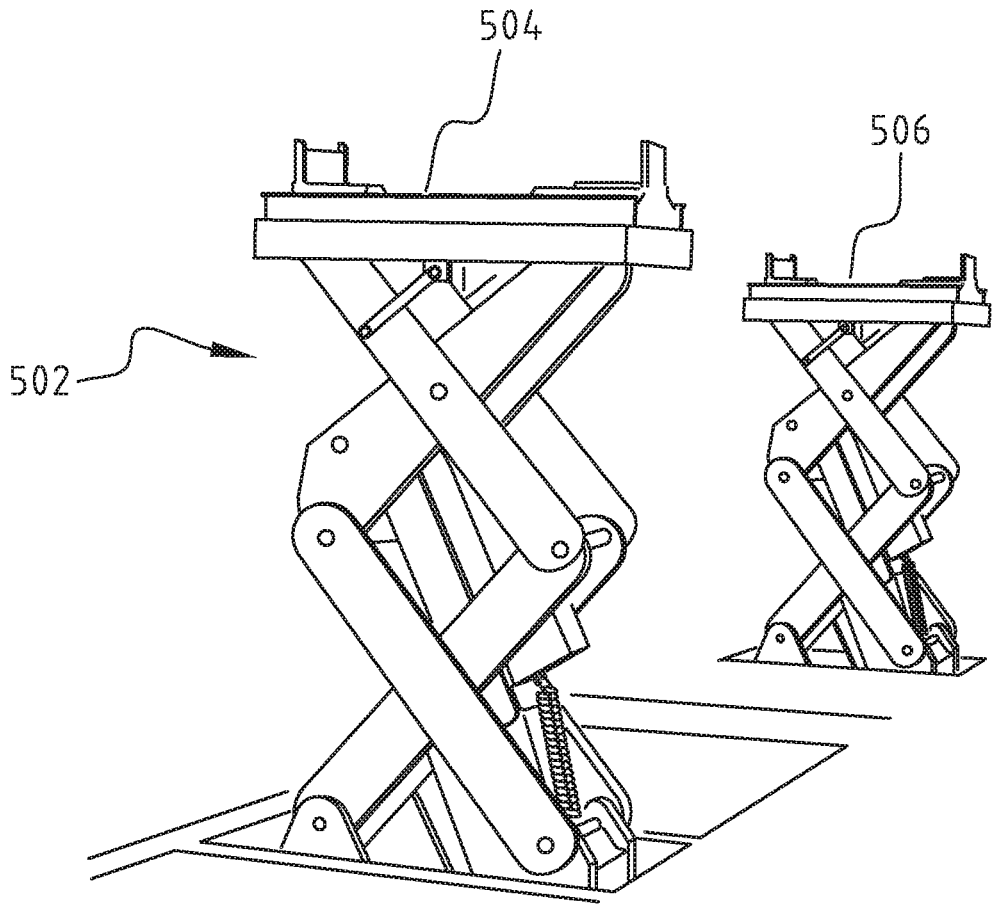

In an alternative lifting system 502 of the in-ground type (FIG. 6) the telescopic lifting cylinders 412, 430 of lifting system 402 are replaced by scissor type lifts 504, 506. It will be understood that operation of lifting systems 402, 502 of the in-ground type is similar.

It will be understood that the invention can be applied to a range of lifting systems, including but not limited to four-post and two-post lifting columns, such as the Stertil-Koni one post lifts ST1075, the Stertil-Koni two post lifts SK 2070, and the Stertil-Koni four post lifts ST 4120, skylift, mobile columns, and in-ground lifts, such as the Stertil in-ground Ecolift and the Stertil in-ground Diamond lift. Also, it will be understood that additional embodiments of the invention can be envisaged combining and/or switching features from the described and/or illustrated embodiments. For example, instead of light 110, 210, or in addition thereto, sound signals, indications on a control system etc. can be applied.

When vehicle 6, 432 needs to be lifted, lifting system 2, 102, 202, 302, 402, 502 is activated. For example, a user can activate the lifting system with remote control 48. Preferably, a safety zone 60, 74 is provided to increase the overall safety. The size of these zones can be adjusted depending on vehicle type and/or carrier height. Carrier height is determined using indoor positioning system 28 in combination with transponders 28*a*, electronic compass 28*b* and "satellites" 28*c*. In case of mobile lifting columns 4, the selection of specific lifting column 4 to be included in a group 2*a*, 2*b* can be done by central controller 22 using information of the specific location and carrier height of available lifting columns 4, for example. Such selection can be presented to the user as a suggestion that requires authorization by the user or can be selected automatically by controller 22. Release system 22 may lock/unlock carrier 16 as an additional safety measure. In case someone or something enters specific parts of safety zone 60, 74, central controller 22 is informed and may instruct release system 72 to lock carrier 16. Carrier 16 can be unlocked after the person or object is removed from safety zone 60, 74, for example. This can be performed automatically or requires user authorization or user input. Positions of persons and/or objects including tools and accessories can be controlled by providing additional transponders 50 in these tools and/or objects. This further enables monitoring and control of the engagement of carrier 16 to vehicle 6, 432 when involving these tools, such as an axle stand, transmission jack or wheel dolly, for example.

The present invention is by no means limited to the above described preferred embodiments. The rights sought are defined by the following claims within the scope of which many modifications can be envisaged. The present invention is described using a lifting device such as a lifting column and more specifically a mobile lifting column. The invention can also be applied to other type of lifting columns such as so-called boom-lifts, scissor-lifts and loading platforms. Such lifting equipment can be provided with the measures illustrated above according to the invention.

The invention claimed is:

1. A lifting system for lifting a vehicle, the system comprising:

one or more lifting devices, each comprising a frame with a carrier configured for carrying the vehicle;

a drive for driving each carrier of the one or more lifting devices in at least one of an ascent or descent of each carrier of the one or more lifting devices;

a controller comprising an indoor positioning system with a transponder, wherein the transponder is provided on or at each carrier of the one or more lifting devices; and a vehicle detector capable of detecting the presence of the vehicle;

wherein the controller further comprises a monitoring system configured for defining a three-dimensional safety zone defined by boundary surfaces bordering each frame of the one or more lifting devices, each carrier of the one or more lifting devices and each drive of the one or more lifting devices and including the vehicle;

wherein the monitoring system comprises an adaptation system configured for adjusting the boundary surfaces of the three-dimensional safety zone to define a working zone and a non-working zone with an operator being capable of operating the lifting system only when the operator is in the working zone;

wherein the non-working zone comprises an inner non-working zone below the vehicle that is lifted and an outer non-working zone;

wherein the working zone comprises an intermediate working zone disposed between the inner non-working zone and the outer non-working zone; and wherein the monitoring system further comprises a warning system configured for providing a warning signal or control signal in response to a person or an object entering or being in the non-working zones of the safety zone such that after the warning signal or the control signal the lifting system is thereafter blocked.

2. The lifting system according to claim 1, wherein the controller further comprises an orientation detector.

3. The lifting system according to claim 2, wherein the orientation detector is a second transponder.

4. The lifting system according to claim 1, wherein the adaptation system responds to a height measurement of each carrier of the one or more lifting devices.

5. The lifting system according to claim 1, wherein the monitoring system comprises an engagement safety system configured for monitoring engagement of each carrier of the one or more lifting devices to the vehicle when lifting the vehicle.

6. The lifting system according to claim 1, wherein the monitoring system comprises a descent safety system configured for monitoring a safe descent of each carrier of the one or more lifting devices.

7. The lifting system according to claim 1, the lifting system further comprising a release system for releasing each carrier of the one or more lifting devices, enabling the lifting system to lift the vehicle.

8. The lifting system according to claim 1, wherein the controller further comprises a remote control.

9. The lifting system according to claim 1, the lifting system comprising two or more sets of lifting devices, wherein each of the sets is configured for lifting a vehicle, and a central controller.

10. The lifting system according to claim 1, further comprising one or more tools and/or accessories that comprise a transponder.

11. A method for lifting a vehicle, the method comprising the steps of:

providing a lifting system according to claim 1;

determining a location and height of each carrier of the one or more lifting devices; and lifting the vehicle with each carrier of the one or more lifting devices.

12. The method according to claim 11, further comprising a step of monitoring the safety zone with the monitoring system to define the working zone and the non-working zones and allowing an operator to operate the lifting system only when the operator is in the working zone.

13. The method according to claim 12, further comprising a step of adapting the boundary surfaces of the safety zone with the adaptation system in response to a height measurement of each carrier of the one or more lifting devices.

14. The method according to claim 11, wherein the lifting system comprises a plurality of lifting devices, the method further comprising a step of selecting the one or more lifting devices for a new lifting operation based on the determined location of the one or more lifting devices or the height of each carrier of the one or more lifting devices thereof.

15. The method according to claim 11 further comprising a step of generating the warning signal or the control signal in response to a person or an object entering or being in the safety zone and blocking operation of the lifting system upon generation of such a signal.

16. The method according to claim 12, wherein the boundary surfaces of the safety zone are adjustable to define customized shapes.

17. The method according to claim 16, wherein the geometric customized shapes of a safety zone include at least two from the group of a rectangle, a dome, a circle, a sphere, and a donut.

* * * * *